US005961084A

United States Patent [19]

Brand et al.

[11] Patent Number: 5,961,084

[45] Date of Patent: Oct. 5, 1999

[54] COMPUTER STORAGE SYSTEM

[76] Inventors: Kim J. Brand, 332 Hickory Dr., Greenfield, Ind. 46140; Rex Townsend, 6232 Catalina Dr., Acton, Ind. 46259

[21] Appl. No.: 09/092,517

[22] Filed: Jun. 5, 1998

[51] Int. Cl.[6] ..... A47G 29/02; A47F 5/00

[52] U.S. Cl. ..... 248/248; 248/300

[58] Field of Search ..... 248/918, 295.11, 248/371, 639, 923, 201, 316.1, 316.4, 316.8, 300; 400/691; 312/223.3; 108/6, 50

[56] References Cited

U.S. PATENT DOCUMENTS

| | | | |
|---|---|---|---|
| 1,784,716 | 12/1930 | West | 248/300 |
| 2,986,366 | 5/1961 | Wesson | 248/285 |
| 3,024,937 | 3/1962 | Kooi | 248/300 |
| 3,178,138 | 4/1965 | Hessdoefer et al. | 248/300 |
| 4,511,111 | 4/1985 | Godfrey et al. | 248/459 |
| 4,974,808 | 12/1990 | Ball | 248/917 |
| 5,419,525 | 5/1995 | Hilton | 248/371 |
| 5,555,694 | 9/1996 | Commins | 248/300 |
| 5,590,021 | 12/1996 | Register | 361/681 |
| 5,683,066 | 11/1997 | McCann | 248/295.11 |

*Primary Examiner*—Derek J. Berger
*Assistant Examiner*—Michael Nornberg
*Attorney, Agent, or Firm*—Michael A. Swift; Ice Miller Donadio & Ryan

[57] ABSTRACT

The invention comprises a computer storage system for use with a desk on a floor, in which the desk has an upper horizontal surface. The system includes an upper horizontal computer monitor receiving surface having an upper side and a lower side, the lower side being engagable with the upper horizontal surface of the desk, and the upper side operable to receive a computer monitor or printer. The system also includes a lower horizontal computer receiving surface operable to receive a computer, and a vertical connecting portion connecting the upper horizontal computer monitor receiving surface with the lower horizontal computer receiving surface. Thus, in operation, the upper horizontal computer monitor receiving surface is operable to suspend and space the storage system from the floor when the upper horizontal computer monitor receiving surface engages the upper horizontal surface of the desk, and the lower horizontal computer receiving surface is biased toward the vertical side surface of the desk, or otherwise fixed or clamped to the desk, when a computer is placed thereon.

9 Claims, 3 Drawing Sheets

COMPUTER STORAGE SYSTEM

FIELD OF THE INVENTION

This invention relates to personal computers, and, in particular, to systems for storing or holding personal computers and/or peripherals therefor in such a way as to optimize available desk space.

BACKGROUND OF THE INVENTION

Personal computers are increasingly common items used by more and more people. Personal computers are manufactured in many shapes and sizes. Unfortunately, however, most smaller personal computers, commonly referred to as laptops or notebooks, are much more expensive than desktop computers. Accordingly, many people are denied the ability to use a personal computer because they have no place to put the relatively large desktop unit or monitor that comprise a personal computer on their modestly sized desk. Accordingly, there is a strong need for a computer storage system that efficiently utilizes available space to store a computer, including the desktop unit, monitor and optionally a printer.

OBJECTS OF THE INVENTION

One object of the invention is to provide a system for storing a personal computer that requires little or no additional space.

Another object of the invention is to provide a system for storing a personal computer monitor and/or printer that effectively increases the surface area of a desktop.

Another object of the invention is to provide a system for storing a personal computer that can be inexpensively manufactured.

Another object of the invention is to provide a system for storing a personal computer that can be easily manufactured and which utilizes few parts.

Another object of the invention is to provide a system for storing a personal computer that can be manufactured in a manner so as to generate little or no waste materials.

SUMMARY OF THE INVENTION

The invention comprises a computer storage system for use with a desk on a floor, in which the desk has an upper horizontal surface and may or may not have a vertical side surface. The system includes an upper horizontal computer monitor receiving surface having an upper side and a lower side, the lower side being engagable with the upper horizontal surface of the desk, and the upper side operable to receive a computer monitor and/or printer. The system also includes a lower horizontal computer receiving surface operable to receive a computer, and a vertical connecting portion connecting the upper horizontal computer monitor receiving surface with the lower horizontal computer receiving surface. Thus, in operation, the upper horizontal computer monitor receiving surface is operable to suspend and space the storage system from the floor when the upper horizontal computer monitor receiving surface engages the upper horizontal surface of the desk, and the lower horizontal computer receiving surface is biased toward the vertical side surface of the desk when a computer is placed thereon.

DETAILED DESCRIPTION

Figure 1:
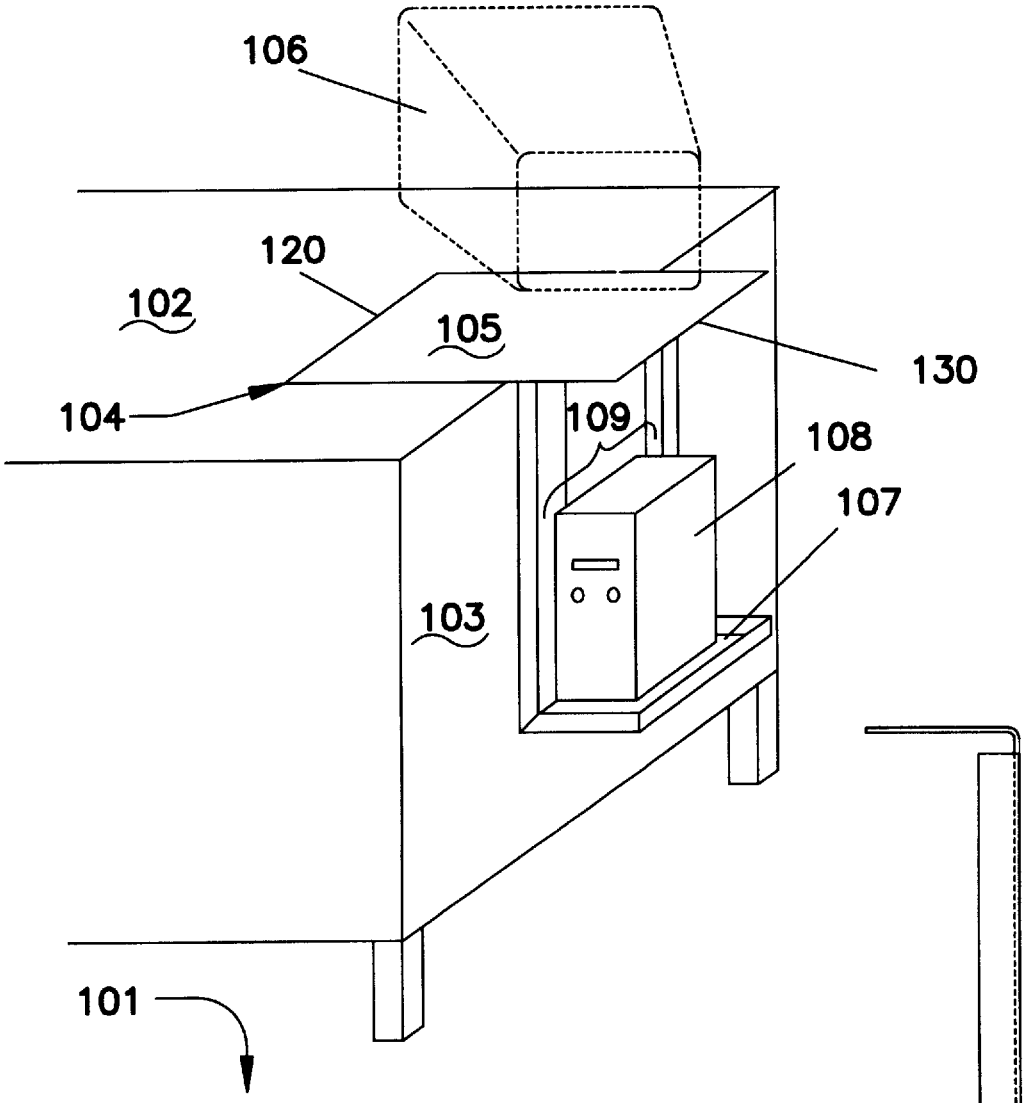
FIG. 1 is a perspective view of a computer storage system of the present invention positioned on a desk and supporting a personal computer "mini-tower" system and monitor.

FIG. 1 is a perspective view of a computer storage system of the present invention positioned on a desk and supporting a personal computer minitower system and monitor. Desk, which is located on floor 101 includes an upper horizontal surface and a vertical side surface 103. The storage system includes an upper horizontal computer monitor receiving surface having an upper side 105, an lower side (not shown), an inner edge portion (120), and an outer edge portion (130), the lower side being engagable with upper horizontal surface 102 of the desk, and the upper side 105 operable to receive a computer monitor 106. The system further includes a lower horizontal computer receiving surface 107 operable to receive computer 108. A vertical connecting portion 109 connects the upper horizontal computer monitor receiving surface 104 with the lower horizontal computer receiving surface 107. Accordingly, upper horizontal computer monitor receiving surface 104 is operable to suspend and space the storage system from floor 101 when the upper horizontal computer monitor receiving surface 104 engages the upper horizontal surface 102 of the desk, and such that the lower horizontal computer receiving surface 107 is biased, by the center of gravity of computer 108, toward the vertical side surface 103 of the desk. For a desk not having a vertical surface, for example where the desktop is supported only be legs, the system of the present invention may be clamped or otherwise secured to the desktop.

In one embodiment, the vertical connecting portion includes a pair of opposing arms 109 on each side. Moreover, upper horizontal computer monitor receiving surface 104, lower horizontal computer receiving surface 107, and vertical connecting portion 109 may be formed from a single piece of bendable material, such as 14 gauge CRS sheet metal.

Figure 3:
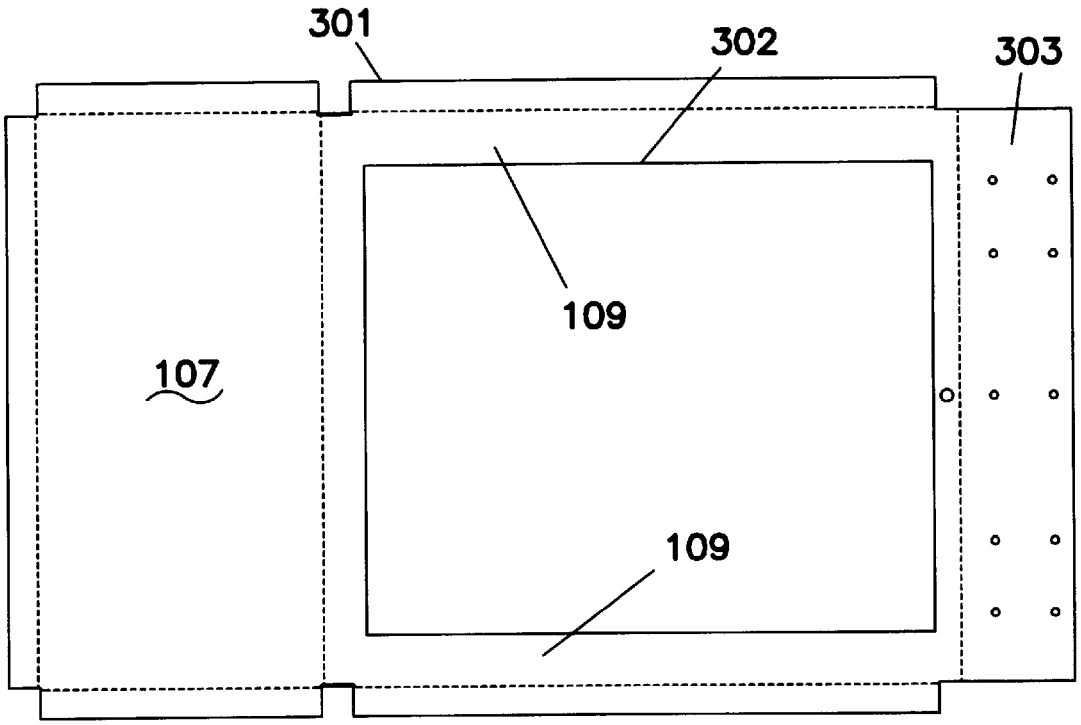
FIG. 3 is a top view of a section of sheet metal showing how a computer storage system of the present invention can be formed therefrom.
Figure 4:
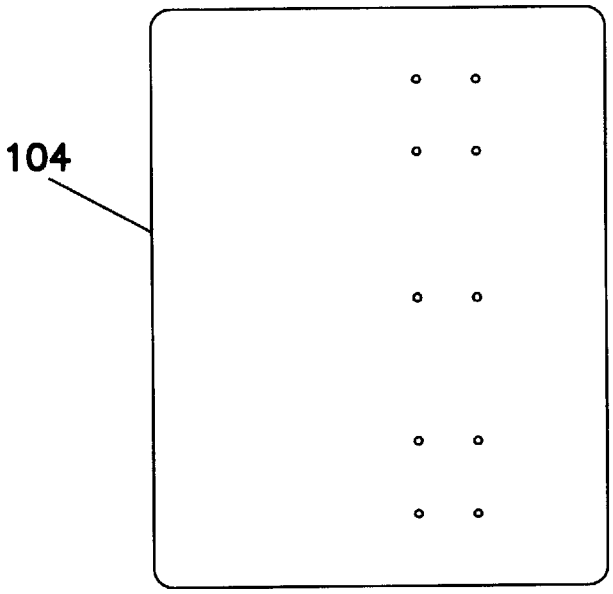
FIG. 4 is a top view of an upper horizontal computer monitor and/or printer receiving surface of a computer storage system of the present invention.

As shown in FIG. 3, a single piece of bendable material such as sheet metal 301 may be used to form all the components of the system. In particular, sheet metal 301 may be stamped or laser cut to form the contours shown in FIG. 3. A central portion 302 of sheet metal may be cut from the remaining portion, and this portion may be used as the upper horizontal computer monitor receiving surface 104 as shown in FIG. 4. Sheet metal 301 may be bent along the dashed lines shown in FIG. 3 to form flanges which improve the structural integrity of lower horizontal computer receiving surface 107, and vertical connecting portion 109.

Figure 2:
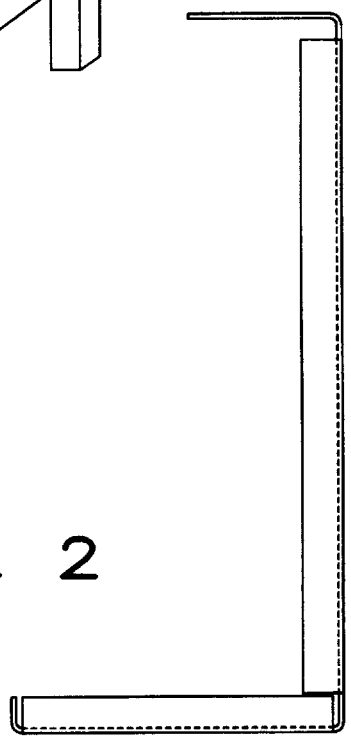
FIG. 2 is a side view of a computer storage system of the present invention, prior to attachment of upper horizontal computer monitor receiving surface.

FIG. 2 is a side view of a computer storage system of the present invention. After upper horizontal computer monitor receiving surface 104 has been stamped from sheet metal 301, it may be spot welded to flange 303 extending from vertical connecting portion 109. In one embodiment, ten spot welds are made to provide secure attachment of these pieces. After all bends and welds of the components have been made, the system may be painted to provide an attractive exterior finish.

As shown in FIG. 1, the system may be positioned such that upper horizontal computer monitor receiving surface 104 engages desktop 102 and also partially extends beyond the edge of desktop 102. This permits a monitor or printer to be placed on upper horizontal computer monitor receiving surface 104 such that part of the base of the monitor extends beyond the edge of the desktop, yet it is still supported by upper horizontal computer monitor receiving surface 104. This increases the desktop space available to the user of the desk over what would be the case if the monitor base where placed entirely on the desktop. Moreover, it will be appreciated by those of skill in the art that the weight of computer 108 will be such that its center of gravity will force lower horizontal computer receiving surface 107 to be biased toward the vertical side surface 103 of the desk. As shown, the desk has a vertical surface engaged by lower horizontal computer receiving surface 107, however, the surface need not necessarily be an entire side desk panel as shown in FIG. 1. For example a vertical desk leg or a horizontally extending bar along the side of the desk may suffice, and such construction is included within the definition of vertical side surface as used in the claims. Alternatively, a spacer may be placed between the desk and lower horizontal computer receiving surface 107, for example a telescoping spacer, to prevent non-horizontal displacement.

Figure 5:
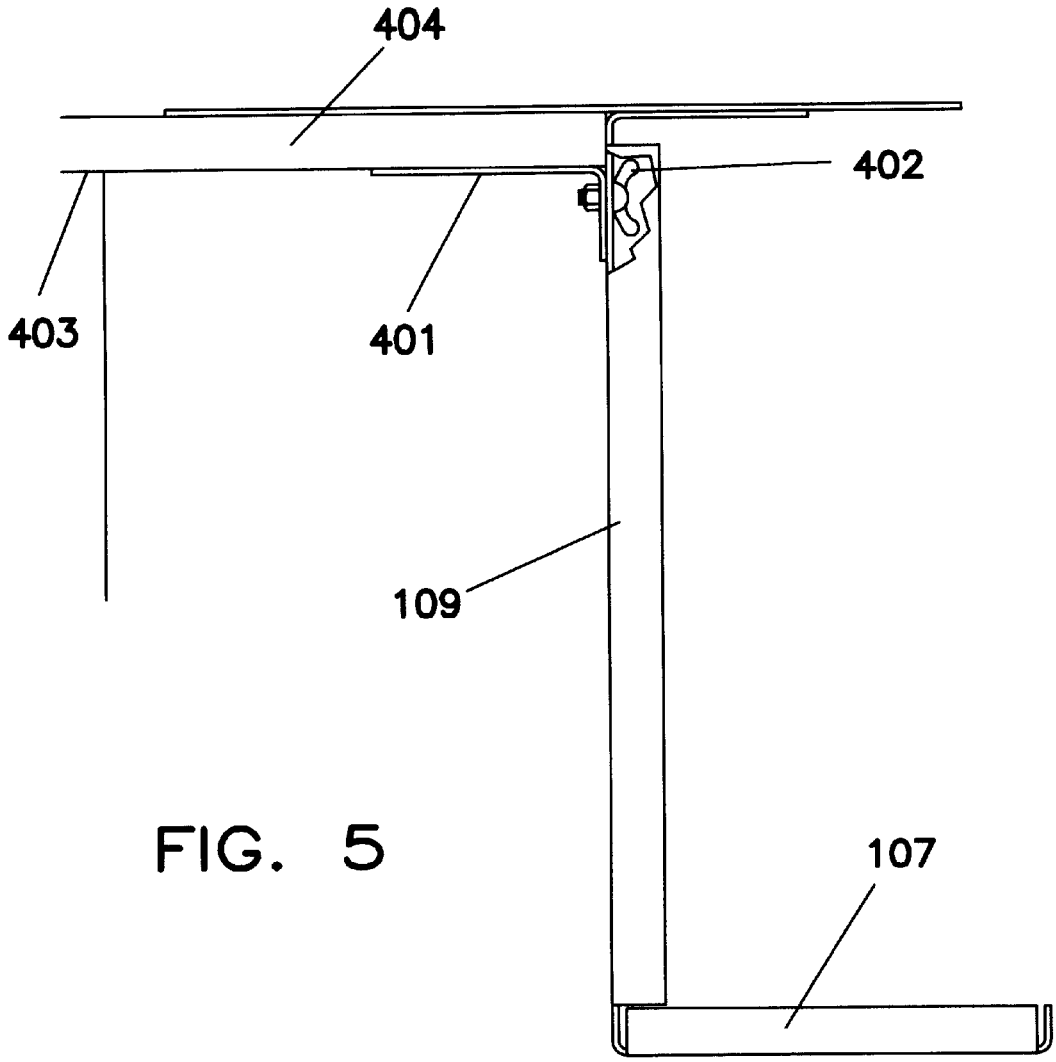
FIG. 5 is a side view of the upper portion of a desk with an overhanging desktop, and with the computer storage system configured with a slidable clamp to secure the system to the desktop.
Figure 6:
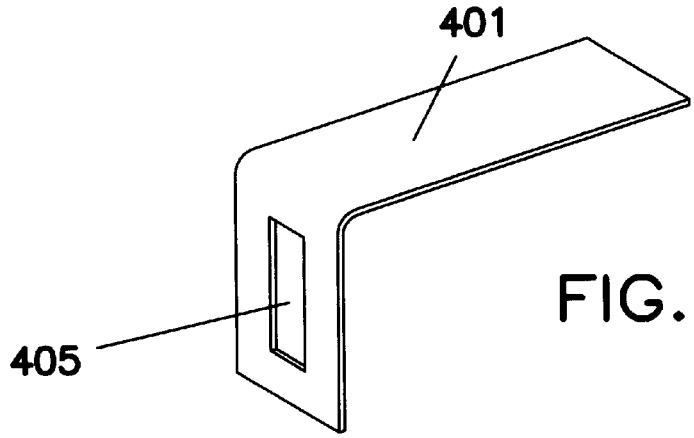
FIG. 6 is a perspective view of a clamp used to secure the computer storage system to a desktop.

In an alternate embodiment, a side view of which is shown in FIG. 5, the system includes clamp 401, which is secured by wing nut 402 to vertical connecting portion 109. Clamp 401 may be positioned to engage the underneath surface 403 of desktop 404. As shown in FIG. 6, clamp 401 may include slot 405 so that clamp 401 may be secured to desktops of various thicknesses.

It will be understood that the above embodiments are merely exemplary, and that those of ordinary skill in the art may readily devise their own implementations that incorporate the principles of the present invention and fall within the spirit and scope thereof.

We claim:

1. A computer storage system for use with a desk on a floor, the desk having an upper horizontal surface and a vertical side surface, comprising:

a) an upper horizontal computer monitor receiving surface having an upper side and a lower side, the lower side being engageable with the upper horizontal surface of the desk, and the upper side operable to receive a computer monitor or printer;

b) a lower computer receiving surface operable to receive a computer;

c) a vertical connecting portion connecting the upper horizontal computer monitor receiving surface with the lower horizontal computer receiving surface wherein the upper horizontal computer monitor receiving surface, the lower horizontal computer receiving surface, and the vertical connecting portion are formed from a single sheet of material, and the upper horizontal computer monitor receiving surface comprises a portion of the sheet material that has been cut from the vertical connecting portion; and d) such that the upper horizontal computer monitor receiving surface is operable to suspend and space the storage system from the floor when the upper horizontal computer monitor receiving surface engages the upper horizontal surface of the desk, and such that the lower horizontal computer receiving surface is biased toward the vertical side surface of the desk when a computer is placed thereon.

2. A computer storage system for use with a desk on a floor, the desk having an upper horizontal surface and a vertical side surface, comprising:

a) an upper horizontal computer monitor receiving surface having an upper side and a lower side, the lower side being engageable with the upper horizontal surface of the desk, and the upper side operable to receive a computer monitor or printer;

b) the upper horizontal computer monitor receiving surface further comprising an inner edge portion and an outer edge portion;

c) a lower horizontal computer receiving surface operable to receive a computer;

d) a vertical connecting portion connecting the upper horizontal computer monitor receiving surface with the lower horizontal computer receiving surface whereby the vertical connecting portion depends downwardly from the lower side of the upper horizontal computer monitor receiving surface intermediately of said edge portions; and e) such that when the computer storage system is mounted on the desk, the outer edge portion extends outwardly from the vertical side surface of the desk creating additional available surface area to receive the computer monitor or the printer, and such that the lower horizontal computer receiving surface is biased toward the vertical side surface of the desk when a computer is placed thereon.

3. The computer storage system as in claim 2, further comprising:

a vertical connecting portion connecting the upper horizontal computer monitor receiving surface with the lower horizontal computer receiving surface wherein the upper horizontal computer monitor receiving surface, the lower horizontal receiving surface, and the vertical connecting portion are formed from a single sheet of material, and the upper horizontal computer monitor receiving surface comprises a portion of the sheet material that has been cut from the vertical connecting portion.

4. The computer storage system as in claim 1, further comprising:

a clamping devise connected to the vertical connecting portion, the clamping device comprising a lower horizontal desktop engaging surface, such that the computer storage system may be secured to the desk.

5. The computer storage system as in claim 2, further comprising:

a clamping devise connected to the vertical connecting portion, the clamping device comprising a lower horizontal desktop engaging surface, such that the computer storage system may be secured to the desk.

6. The computer storage system as in claim 3, further comprising:

a clamping devise connected to the vertical connecting portion, the clamping device comprising a lower horizontal desktop engaging surface, such that the computer storage system may be secured to the desk.

7. The computer storage system as in claim 4 wherein the clamping device comprises a slot formed therein to permit the distance between the clamping device and the upper horizontal computer monitor receiving surface to be adjusted.

8. The computer storage system as in claim 5 wherein the clamping device comprises a slot formed therein to permit the distance between the clamping device and the upper horizontal computer monitor receiving surface to be adjusted.

9. The computer storage system as in claim 6 wherein the clamping device comprises a slot formed therein to permit the distance between the clamping device and the upper horizontal computer monitor receiving surface to be adjusted.

* * * * *